US008182055B2

(12) United States Patent
Yun et al.

(10) Patent No.: US 8,182,055 B2
(45) Date of Patent: May 22, 2012

(54) DAMPING UNIT AND REFRIGERATOR HAVING THE SAME

(75) Inventors: Kwon Chul Yun, Gangju (KR); Chang Hun Cho, Gangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 686 days.

(21) Appl. No.: 12/314,340

(22) Filed: Dec. 8, 2008

(65) Prior Publication Data

US 2009/0261701 A1 Oct. 22, 2009

(30) Foreign Application Priority Data

Apr. 22, 2008 (KR) ..... 20-2008-0005287
Aug. 8, 2008 (KR) ..... 10-2008-0077790

(51) Int. Cl.
*A47B 96/00* (2006.01)

(52) U.S. Cl. ..... 312/405; 312/292; 188/290

(58) Field of Classification Search ..... 312/402, 312/404, 405, 319.1, 319.2; 16/50, 54; 49/386, 49/398; 188/266, 290, 296, 306; 267/155
See application file for complete search history.

(56) References Cited

U.S. PATENT DOCUMENTS 4,215,449 A * 8/1980 Loikitz ..... 16/50
4,756,051 A * 7/1988 Shy ..... 16/50
5,031,270 A * 7/1991 Lee ..... 16/50
5,109,571 A * 5/1992 Ohshima et al. ..... 16/307
5,111,548 A * 5/1992 Ohshima ..... 16/51
5,170,530 A * 12/1992 Kopec et al. ..... 16/52
5,277,282 A * 1/1994 Umemura ..... 188/290
6,457,207 B1 * 10/2002 Horberg ..... 16/50
6,618,902 B2 * 9/2003 Wu ..... 16/298
6,817,061 B2 * 11/2004 Wu et al. ..... 16/308
6,845,545 B2 * 1/2005 Han et al. ..... 16/277
6,913,125 B2 * 7/2005 Hayashi ..... 188/290
6,922,869 B2 * 8/2005 Bivens et al. ..... 16/54
6,971,359 B2 * 12/2005 Tohyama ..... 123/185.3
7,275,626 B2 * 10/2007 Fukuzawa et al. ..... 188/296
7,484,266 B1 * 2/2009 Yang ..... 16/54
2003/0177605 A1 * 9/2003 Wang ..... 16/50
2003/0177606 A1 * 9/2003 Lee ..... 16/50

(Continued)

FOREIGN PATENT DOCUMENTS

KR 10-2004-0046467 6/2004

*Primary Examiner* — James O Hansen
*Assistant Examiner* — Sasha T Varghese
(74) *Attorney, Agent, or Firm* — Staas & Halsey LLP

(57) ABSTRACT

Disclosed is a refrigerator. The refrigerator includes a body, a refrigerator door for opening/closing a front surface of the body, with the refrigerator door having an opening, an auxiliary door for opening/closing the opening of the refrigerator door, and a damping unit coupled to a hinge shaft of the auxiliary door to control an opening/closing speed of the auxiliary door. The damping unit includes a case, a rotating member rotatably installed in the case, oil filled in the case to apply resistance against rotation of the rotating member, a fixing member coupled to an end portion of a rotating shaft of the rotating member to rotate together with the rotating member, and an elastic member provided between the case and the fixing member to apply elastic force to the fixing member in a direction opposite to an opening direction of the auxiliary door. It is possible to stably rotate the auxiliary door while controlling the rotational speed of the auxiliary door.

20 Claims, 10 Drawing Sheets

U.S. PATENT DOCUMENTS

2004/0216471 A1* 11/2004 Kim et al. ..... 62/126
2005/0189184 A1* 9/2005 Osvatic et al. ..... 188/138
2005/0193523 A1* 9/2005 Nam et al. ..... 16/330
2006/0119240 A1* 6/2006 Shin et al. ..... 312/405
2006/0138920 A1* 6/2006 Jang ..... 312/405
2006/0207843 A1* 9/2006 Migli ..... 188/282.1
2006/0226750 A1* 10/2006 Lee et al. ..... 312/405.1
2006/0230573 A1* 10/2006 Kao ..... 16/50
2006/0255045 A1* 11/2006 Kim ..... 220/531
2007/0089273 A1* 4/2007 Kang ..... 16/330
2009/0064462 A1* 3/2009 Yin et al. ..... 16/330
2009/0151121 A1* 6/2009 Lin ..... 16/321

* cited by examiner

DAMPING UNIT AND REFRIGERATOR HAVING THE SAME

CROSS-REFERENCE TO RELATED APPLICATIONS

This application claims the benefit of Korean Utility Model Application No. 20-2008-0005287 filed on Apr. 22, 2008, in the Korean Intellectual Property Office, and Korean Patent Application No. 10-2008-0077790 filed on Aug. 8, 2008, in the Korean Intellectual Property Office, the disclosures of which are incorporated herein by reference.

BACKGROUND

1. Field

Embodiments of the present invention relate to a damping unit and a refrigerator having the same. More particularly, embodiments of the present invention relate to a damping unit and a refrigerator having the same, which can stably rotate a home bar door and can control the rotational speed of the home bar door.

2. Description of the Related Art

In general, a refrigerator is an appliance that supplies cold air to a storage compartment storing various foodstuffs so as to allow the foodstuffs to be kept in a fresh state at a low temperature condition. The refrigerator includes a freezing compartment maintained at the temperature below the freezing temperature and a refrigerating compartment maintained at the temperature slightly above the freezing temperature.

Recently, various types of refrigerators, such as a Top Mounted Freezer (TMF) type refrigerator having a freezing compartment at an upper portion of the refrigerator, a Bottom Mounted Freezer (BMF) type refrigerator having the freezing compartment at a lower portion of the refrigerator, and a Side By Side (SBS) type refrigerator having the freezing compartment at one side of the refrigerator, have been developed to store various foodstuffs therein.

To suit improvements in human life style, refrigerators are manufactured in a large size and are equipped with various functions. A home bar is installed in a door of the refrigerator to allow a user to take out beverages or drinks stored in the refrigerator without opening the door.

Such a home bar includes a home bar door to open/close an opening that is formed by removing a part of a refrigerator door such that the interior of the refrigerator is communicated with the exterior of the refrigerator, and a basket fixed to an inner portion of the home bar door to store beverages or drinks therein.

In general, in order to open/close the opening formed in the refrigerator door, the home bar door is rotatably connected to a front portion of the refrigerator door by upper and lower link units such that the home bar door can rotate at an angle of 90 degrees.

However, when the home bar door having the above structure is open, the link units having the foldable structure may generate noise due to ware thereof. In addition, the link units are exposed to the outside, so that the aesthetic appearance of the refrigerator may deteriorate.

In order to solve the above problem, a new home bar door capable of improving the aesthetic appearance of the refrigerator has been proposed. According to the home bar door, rod-shape hinges protrude at both sides of a lower end of the home bar door, and the hinges are rotatably inserted into hinge holes formed at both sides of a lower end portion of the opening, so that the home bar door rotates about the hinge shafts to open/close the opening.

In addition, a home bar door including a damping unit equipped with an oil damper and provided on hinge shafts has been developed. The home bar door is slowly opened or closed due to the damping unit so that noise can be reduced and the opening/closing operation of the home bar door can be smoothly achieved when the home bar door is rotatably moved up and down about the hinge shafts.

However, the damping unit having the oil damper may not constantly rotate because flow resistance of oil may vary depending on oil viscosity and temperature variation, so that the home bar door may not be stably rotated and performance of the damping unit may be gradually degraded.

In addition, the damping unit having the oil damper may apply deceleration resistance to the hinge shafts when the home bar door is rotatably moved up and down. Thus, resistance force of the oil damper is added to the weight of the home bar door when the home bar door is rotatably moved up to close the opening, so that the user must apply stronger force to the home bar door to operate the home bar door.

Further, the damping unit having the oil damper may not control the rotational speed of the home bar door when the home bar door is rotatably moved up and down, so that the home bar door does not accommodate the demand of users.

SUMMARY

Accordingly, it is an aspect of embodiments of the present invention to provide a refrigerator having a home bar door which can stably rotate regardless of temperature variation even if the home bar door is used for a long period of time.

Another aspect of embodiments of the present invention is to provide a refrigerator having a home bar door, in which the rotational speed of the home bar door can be simply controlled, so that a user can properly set the rotational speed of the home bar door according to the preference of the user.

Still another aspect of embodiments of the present invention is to provide a refrigerator having a home bar door, in which a damping unit of the home bar door is minimized, so that an installation space for the damping unit can be reduced, the aesthetic appearance of the refrigerator can be enhanced, and space utility of the refrigerator can be improved.

Additional aspects and/or advantages will be set forth in part in the description which follows and, in part, will be apparent from the description, or may be learned by practice of the invention.

The foregoing and/or other aspects of embodiments of the present invention are achieved by providing a refrigerator including a body, a refrigerator door for opening/closing a front surface of the body and having an opening, an auxiliary door for opening/closing the opening of the refrigerator door, and a damping unit coupled to a hinge shaft of the auxiliary door to control an opening/closing speed of the auxiliary door, wherein the damping unit includes a case, a rotating member rotatably installed in the case, oil filled in the case to apply resistance against rotation of the rotating member, a fixing member coupled to an end portion of a rotating shaft of the rotating member to rotate together with the rotating member, and an elastic member provided between the case and the fixing member to apply elastic force to the fixing member in a direction opposite to an opening direction of the auxiliary door.

The elastic member may include a torsion spring having a body with an annular coil shape configured to surround the rotating shaft, and a pair of lever sections provided at upper and lower ends of the body. The lever sections include a first lever section fixed to the case and a second lever section fixed to the fixing member.

The fixing member may be formed with a slot into which the second lever section is accommodated.

The slot may include a guide section along which the second lever section slidably moves, and a stopper section for restricting movement of the second lever section.

The slot may be located at a predetermined position of the fixing member to apply torsional force to the torsion spring such that the auxiliary door is securely maintained in a closed position.

The hinge shaft may be integrally formed with the rotating shaft.

According to another aspect, embodiments of the present invention provide a refrigerator including a body, a refrigerator door for opening/closing a front surface of the body and having an opening, an auxiliary door for opening/closing the opening of the refrigerator door, and a damping unit coupled to a hinge shaft of the auxiliary door to control an opening/closing speed of the auxiliary door, wherein the damping unit includes an oil damper having a case, a rotating member rotatably installed in the case, and oil filled in the case to apply resistance against rotation of the rotating member, an engagement member coupled to the rotating member to rotate together with the rotating member, and an elastic member applying elastic force to the engagement member in a direction opposite to an opening direction of the auxiliary door.

The engagement member may include a head section having a hinge hole into which the hinge shaft is inserted, a receiving section for receiving the elastic member, and a coupling section coupled to the rotating section.

The elastic member may include a torsion spring, which surrounds the receiving section and has one end fixed to the case and an opposite end fixed to the head section.

The head section may be formed with a slot into which the opposite end of the torsion spring is accommodated.

The slot may include a guide section along which the opposite end of the torsion spring slidably moves, and a stopper section for restricting movement of the opposite end of the torsion spring.

The slot may be located at a predetermined position of the head section to apply torsional force to the torsion spring such that the auxiliary door is securely maintained in a closed position.

The engagement member may be integrally formed with the rotating member.

According to another aspect, embodiments of the present invention provide a damping unit for a refrigerator including a damper including an oil filled case with a case cover, providing resistance, and a rotating member rotatably installed in the case comprising a rotating shaft. The damper further includes a fixing member coupled to the rotating shaft, and an elastic member between the fixing member and the case cover, applying elastic force to the fixing member in a direction opposite to a rotating direction of the fixing member.

The elastic member may be a torsion spring.

The rotating shaft may have an end portion protruding out of a perforation hole of the case cover.

The fixing member may be formed with an insertion hole into which the end portion of the rotating shaft is inserted.

The insertion hole may have a polygonal shape to allow the fixing member to rotate together with the rotating shaft.

The fixing member may have a slot for fixing or guiding a second lever section of the torsion spring such that torsional force can be applied to the torsion spring according to the rotation direction of the fixing member.

A position of the slot formed in the fixing member may be selected to adjust torsional force of the torsion spring.

As described above, according to the refrigerator of embodiments of the present invention, the damping unit has the oil damper and the torsion spring and the torsion spring can compensate for variation of flow resistance of oil even if the flow resistance of oil is changed according to the temperature, so that the home bar door can stably rotate.

In addition, according to the refrigerator of embodiments of the present invention, when the home bar door is rotatably moved up to close the opening, resistance force of the oil damper is compensated by elastic force of the torsion spring, so that the user can rotate the home bar door in the upward direction with relatively little force.

Further, according to the refrigerator of embodiments of the present invention, the torque value of the torsion spring can be adjusted depending on the location and shape of the fixing hole to which one end of the torsion spring of the damping unit is fixed, so that the user can properly set the rotational speed of the home bar door according to their preference.

In addition, according to the refrigerator of embodiments of the present invention, the oil damper and the torsion spring of the damping unit of the home bar door may be integrally formed with each other, so that the component structure can be simplified, the manufacturing cost can be reduced, and the size of the damping unit can be minimized. Thus, space utility for the hinge unit of the home bar door can be enhanced and the aesthetic appearance of the refrigerator can be improved.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
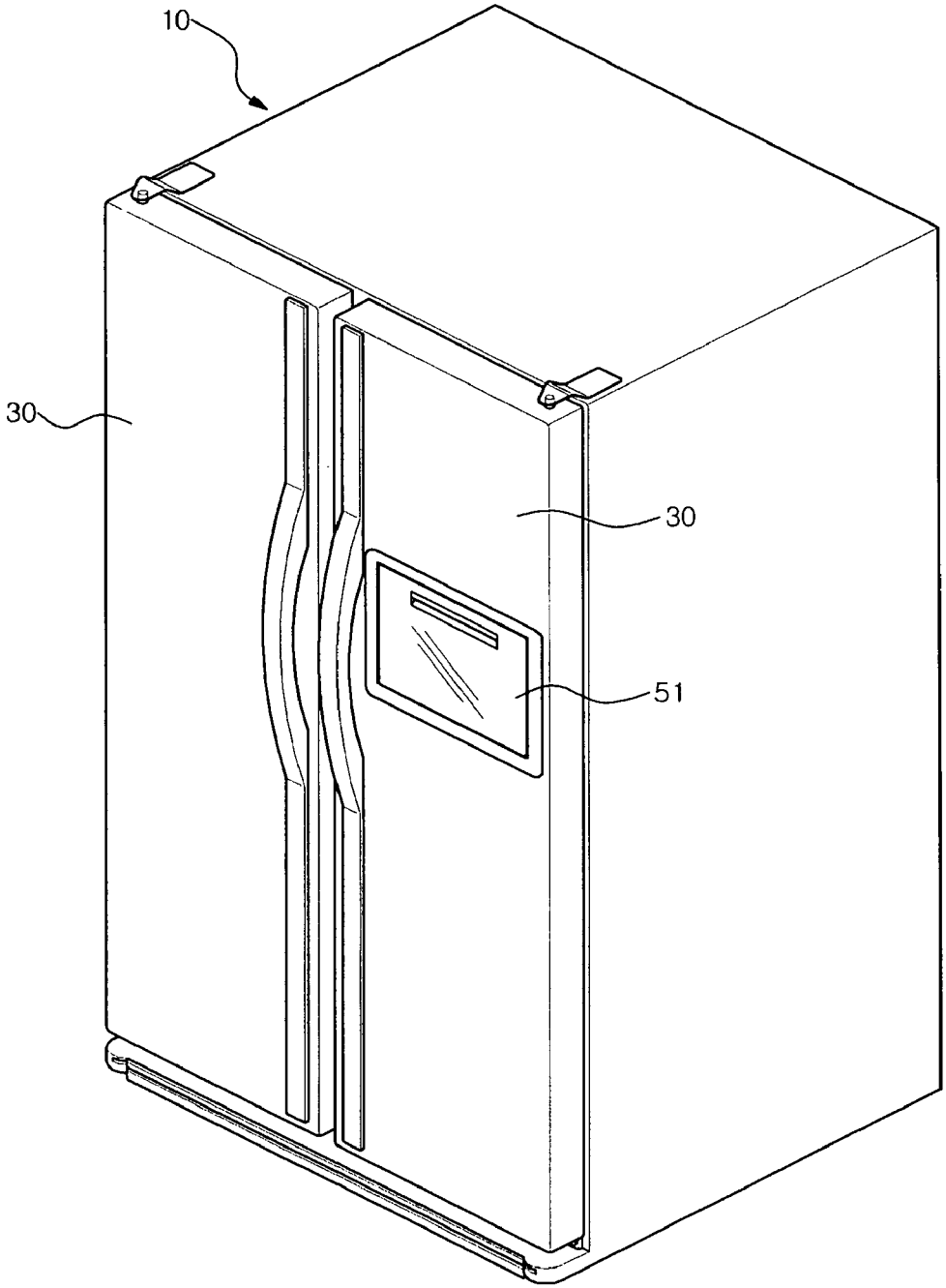
FIG. 1 is a perspective view schematically showing a refrigerator according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

FIG. 1 shows an external appearance of a refrigerator having a home bar door according to an embodiment of the present invention. As shown in FIG. 1, the refrigerator includes a body 10 having a storage compartment therein and a front part of which can be opened, storage compartment doors 30 installed at the front portion of the body 10 for opening/closing the storage compartment including a freezing compartment and/or a refrigerating compartment, a home bar 50 (FIG. 2) installed at the storage compartment door 30 to form a separate storage space in the storage compartment door 30, and an auxiliary door 51 installed at the front portion of the home bar 50 to open/close the home bar 50. Hereinafter, the auxiliary door 51 will be referred to as a home bar door 51. The user can easily take out beverages or drinks from the home bar 50 through the home bar door 51 having a size relatively smaller than a size of the storage compartment door 30 without opening the storage compartment door 30.

Figure 2:
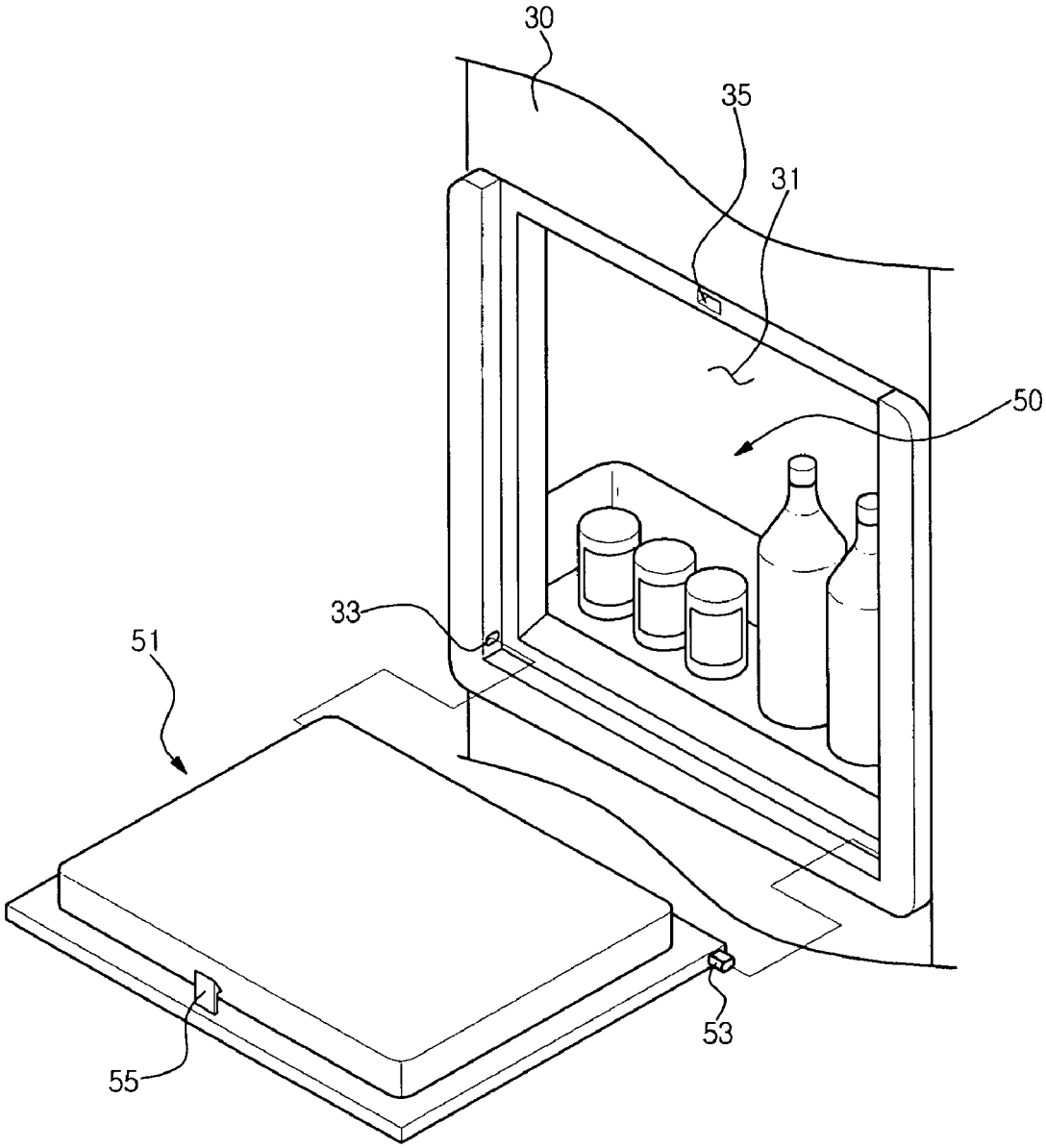
FIG. 2 is a partial perspective view showing a home bar door of FIG. 1, which is separated from a storage compartment door.

FIG. 2 is a partial perspective view showing the home bar door of FIG. 1, which is separated from the storage compartment door according to an embodiment of the present invention.

As shown in FIG. 2, an opening 31 is formed at the front portion of the storage compartment door 30 to allow the user to approach the home bar 50 from the outside of the storage compartment door 30.

The home bar door 51 has a size corresponding to the size of the opening 31 and hinge shafts 53 are coupled to both sides of a lower end portion of the home bar door 51 such that the hinge shafts 53 can be inserted into hinge holes 33, which are formed at both sides of a lower end portion of the opening 31.

The hinge shafts 53 protrude from both lateral sides of the home bar door 51 in the form of rods.

In addition, a hook member 55 is installed at an inner upper portion of the home bar door 51. The hook member 55 cooperates with a latch unit (not shown) provided in a hook hole 35 formed at an upper portion of the opening 31 in order to lock or unlock the home bar door 51 such that the home bar door 51 may open or close the opening 31.

Figure 3:
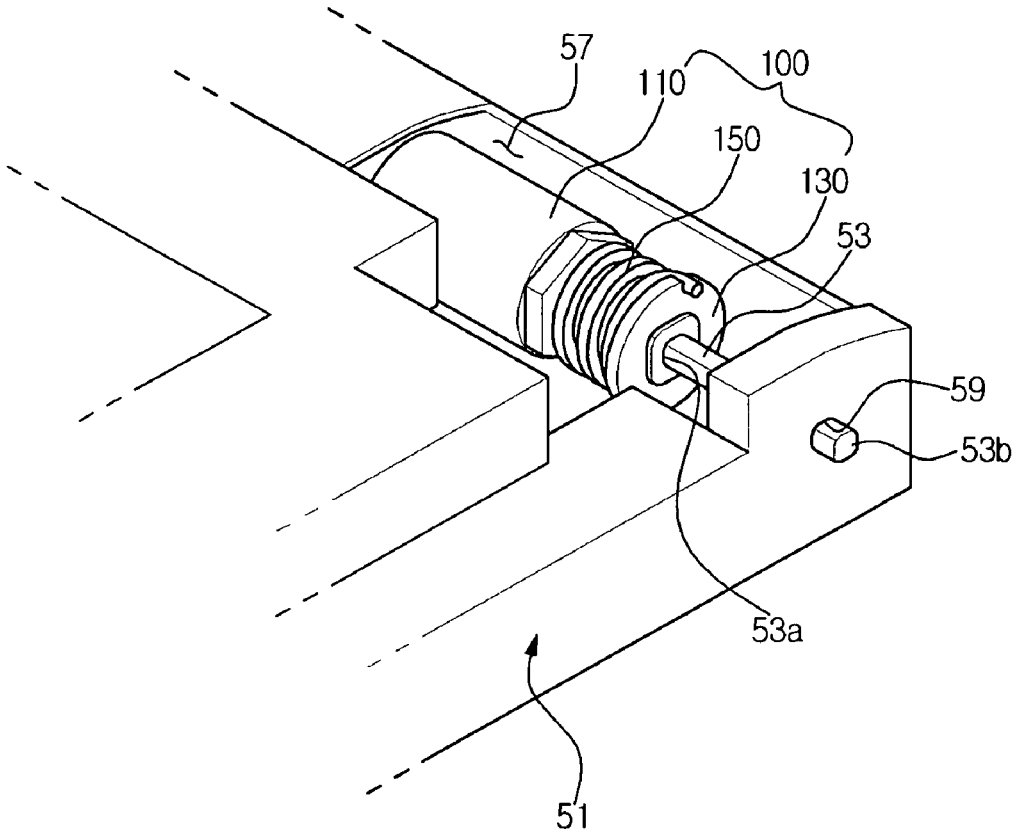
FIG. 3 is a perspective view showing a coupling structure of a damping unit installed adjacent to a hinge shaft according to an embodiment of the present invention.

Referring now to FIG. 3, a damping unit 100 is provided at a lower end portion of a right part of the home bar door 51. The damping unit 100 is coupled with the hinge shaft 53 to decrease the opening speed of the home bar door 51 while enabling smooth opening of the home bar door 51.

Although FIG. 3 shows the damping unit 100 coupled with the hinge shaft 53 provided at the lower end portion of the right part of the home bar door 51, embodiments of the present invention are not limited thereto. According to another embodiment, the damping unit 100 can be coupled with the hinge shaft 53 provided at a lower end portion of a left part of the home bar door 51 in order to apply resistance against rotation of the hinge shaft 53. In addition, the damping unit 100 can be coupled with the both hinge shafts 53 to apply resistance against rotation of the hinge shafts 53.

Referring to FIGS. 2 and 3, the home bar door 51 having the above structure according to an embodiment of the present invention is locked with or unlocked from the opening 31 of the storage compartment door 30 through the hook member 55 and the latch unit (not shown). If the home bar door 51 is rotatably moved down about the hinge shaft 53 after the home bar door 51 is unlocked from the opening 31, the home bar door 51 can be smoothly moved due to the damping unit 100.

Hereinafter, the structure of the damping unit 100 according to an embodiment of the present invention will be described in more detail.

Figure 4:
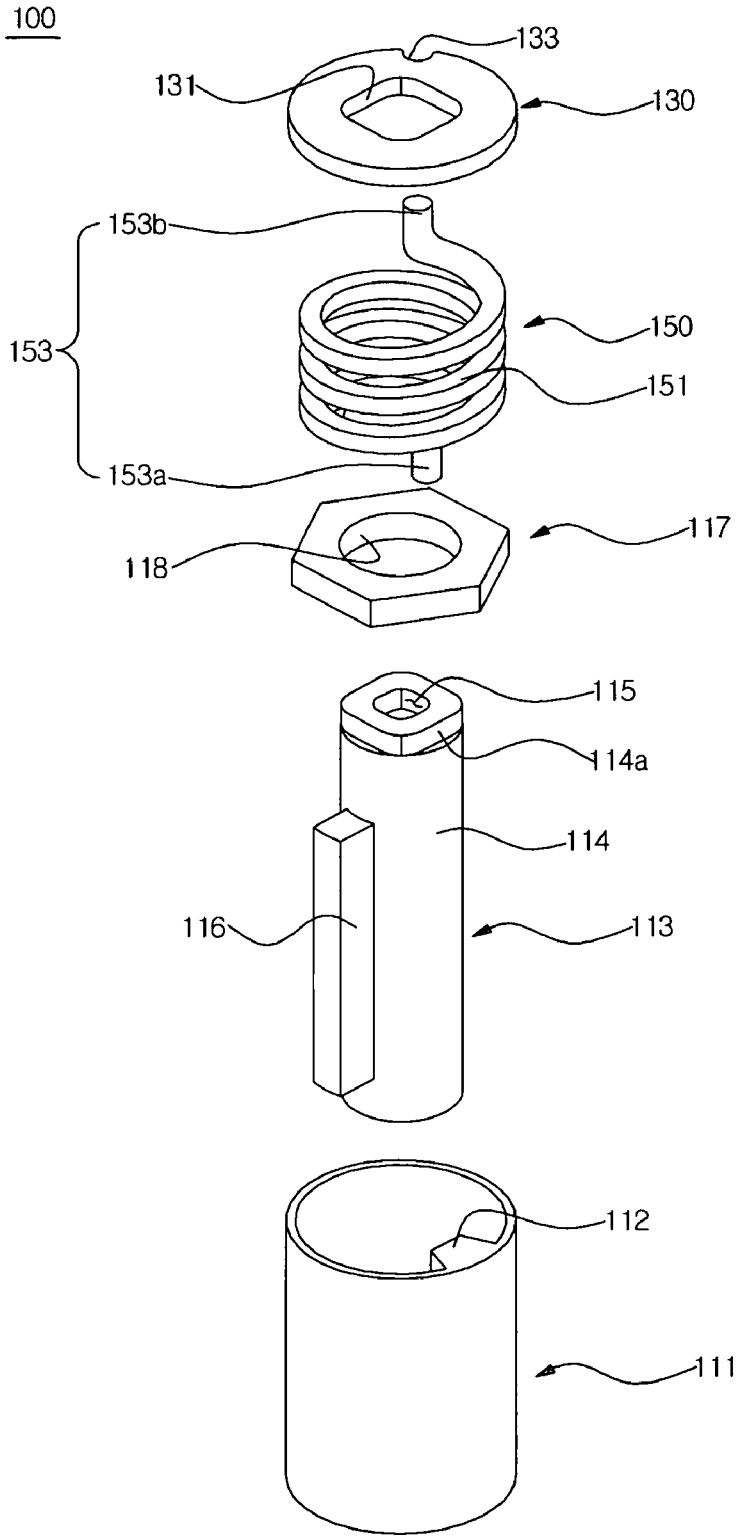
FIG. 4 is an exploded perspective view of a damping unit according to an embodiment of the present invention.

FIG. 3 is a perspective view showing a coupling structure of the damping unit installed adjacent to the hinge shaft according to an embodiment of the present invention, and FIG. 4 is an exploded perspective view of the damping unit according to an embodiment of the present invention.

As shown in FIG. 3, the damping unit 100 is fixedly accommodated in an installation groove 57 formed at the lower end portion of the home bar door 51. As the damping unit 100 has been accommodated in the installation groove 57, the installation groove 57 is covered with a cover (not shown) and fixed by a coupling member (not shown).

Referring to FIG. 4, the damping unit 100 includes an oil damper 110 (FIG. 3) having a case 111 with a hollow structure and an open upper portion, a rotating member 113 rotatably installed in the case 111 and provided with a rotating shaft 114 having an end portion protruding out of the case 111, a case cover 117 for covering the open upper portion of the case 111, and oil filled in the case 111 to apply resistance against rotation of the rotating member 113.

That is, the oil damper 110 compresses oil contained in the case 111 by moving the oil in one direction while the rotating member 113 installed in the case 111 is being rotated, thereby increasing oil pressure. The oil having high pressure may serve as resistance against the rotation of the rotating member 113 so that the rotational speed of the rotating member 113 is decreased.

In other words, the oil damper 110 according to an embodiment of the present invention includes the case 111 having a cup shape, which is filled with high-viscosity oil, and a barrier 112 having a fluid path (not shown) and integrally formed with an inner wall of the case 111.

The rotating member 113 is rotatably installed in the case 111, and a blade 116 is attached to the rotating member 113 such that the blade 116 can slidably move along the inner wall of the case 111.

The case cover 117 is coupled with the open upper portion of the case 111 to prevent oil leakage. The case cover 117 is formed with a perforation hole 118 and one end 114*a* of the rotating shaft 114 of the rotating member 113 protrudes out of the case cover 117 through the perforation hole 118.

An insertion hole 115 is formed in one end 114*a* of the rotating shaft 114 that protrudes out of the case cover 117, and one end of the hinge shaft 53 (FIG. 3) is inserted into the insertion hole 115. The insertion hole 115 has a polygonal shape to allow the rotating shaft 114 to rotate together with the hinge shaft 53.

According to an embodiment of the present invention, as shown in FIGS. 3 and 4, one end 53*a* of the hinge shaft 53 is inserted into the insertion hole 115 formed in one end 114*a* of the rotating shaft 114 and the other end 53*b* of the hinge shaft 53 protrudes to the outside by passing through a perforation hole 59 of the home bar door 51. However, according to embodiments of the present invention, the rotating shaft 114 may be integrally formed with the hinge shaft 53 such that the one end 114*a* of the rotating shaft 114 may serve as a hinge shaft.

In addition, the hinge shaft 53 and the insertion hole 115 can be provided at the lower portion of the opening 31 (FIG. 2), and the hinge hole 33 (FIG. 2) can be formed in the home bar door 51.

The damping unit 100 further includes a fixing member 130 coupled to one end 114*a* of the rotating shaft 114 to rotate together with the rotating shaft 114.

The fixing member 130 is formed with an insertion hole 131 into which the one end 114*a* of the rotating shaft 114 is inserted. The insertion hole 131 has a polygonal shape to allow the fixing member 130 to rotate together with the rotating shaft 114.

An elastic member 150 is provided between the fixing member 130 and the case cover 117 in order to apply elastic force in the direction opposite to the rotating direction of the fixing member 130 that rotates together with the rotating shaft 114.

According to an embodiment of the present invention, the elastic member 150 includes a spring that applies elastic force in the direction opposite to the rotating direction of the fixing member 130. Preferably, a torsion spring, which is easily installed in a narrow space and generates repulsive force as torsion is applied thereto from a rotating object, is used as the elastic member 150.

As shown in FIG. 4, the torsion spring includes a body 151 having an annular coil shape, and a pair of lever sections 153 provided at upper and lower end portions of the body 151.

The body 151 is fitted around the rotating shaft 114 that protrudes out of the case cover 117, and the lever sections 153 include a first lever section 153*a* fixed to the case cover 117 or the case 111, and a second lever section 153*b* coupled to the one end 114*a* of the rotating shaft 114. The torsion spring generates torsional force as the fixing member 130 rotates.

Since the torsion spring has mechanical characteristics, which are not greatly affected by environmental conditions, when the torque value of the rotating shaft 114 is changed due to the change in viscosity of oil filled in the case 111 caused by temperature variation, the torsion spring compensates for variation of the torque value of the rotating shaft 114, thereby allowing the rotating shaft 114 to rotate at a constant rotational speed.

In addition, the mechanical characteristics of the torsion spring, such as a spring material, a wire diameter, an effective winding number, and a spring constant, can be properly adjusted according to the viscosity of oil and the weight of the home bar door 51, so that the quality of the damping unit 100 can be constantly maintained. In addition, since the oil damper 110 is integrally formed with the torsion spring serving as the elastic member 150, the size of the damping unit 100 can be minimized. Thus, the installation space for installing the damping unit 100 in the home bar door 51 can be reduced, so that the aesthetic appearance of the refrigerator may be improved.

The fixing member 130 has a slot 133 for fixing or guiding the second lever section 153*b* of the torsion spring such that torsional force can be applied to the torsion spring according to the rotation of the fixing member 130.

Figure 5:
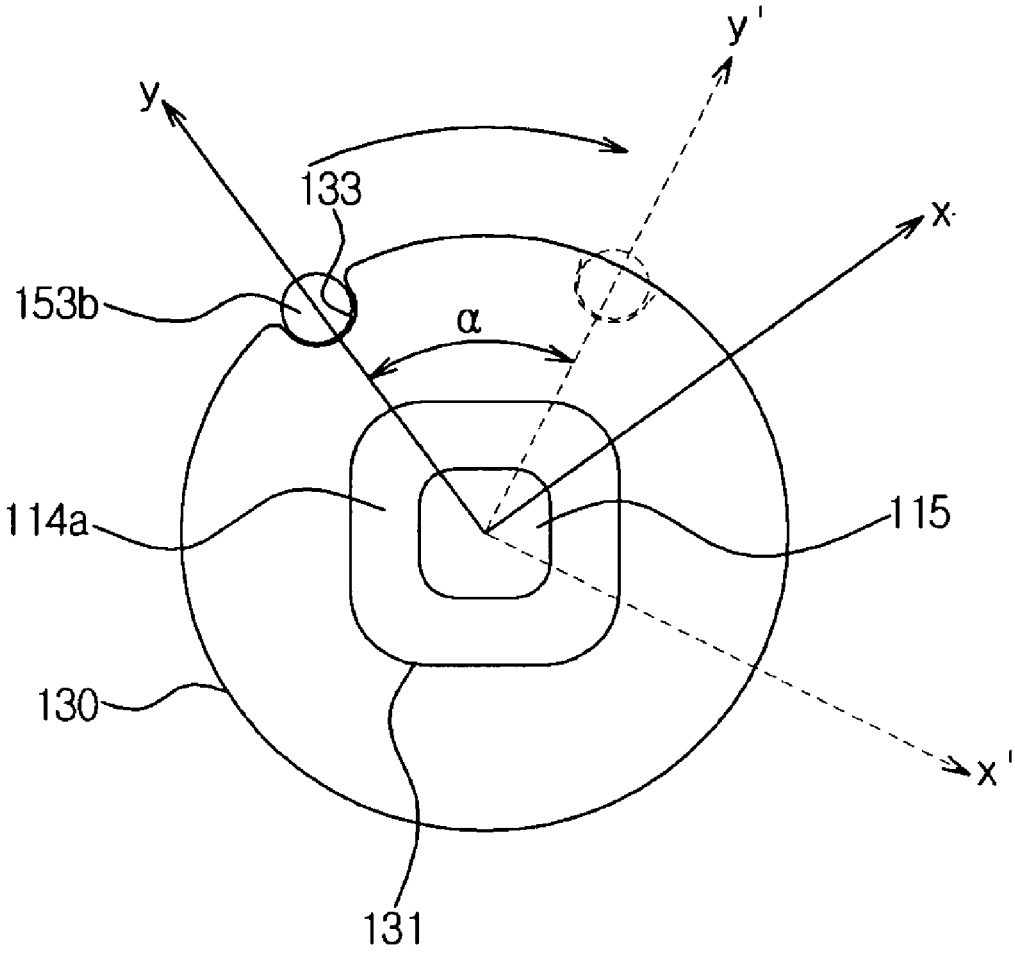
FIG. 5 is a sectional view of a damping unit according to an embodiment of the present invention.

The position of the slot 133 formed in the fixing member 130 can be properly selected to adjust torsional force of the torsion spring. That is, as shown in FIG. 5, when the fixing member 130 rotates clockwise about the y-axis, the second lever section 153*b* of the torsion spring accommodated in the slot 133, which is aligned in the y-axis, also rotates clockwise, so that torsional force of the torsion spring is changed.

If the slot 133 is located in the y'-axis, which is remote from the y-axis by a predetermined angle $\alpha$, the torsion spring may have torsional force different from the initial torsional force of the torsion spring.

In this manner, the rotational speed of the rotating shaft 114 (FIG. 4) can be controlled by adjusting the torsional force of the torsion spring. In addition, the home bar door 51 can be securely maintained in the closed position by properly setting the torsional force of the torsion spring.

Figure 6:
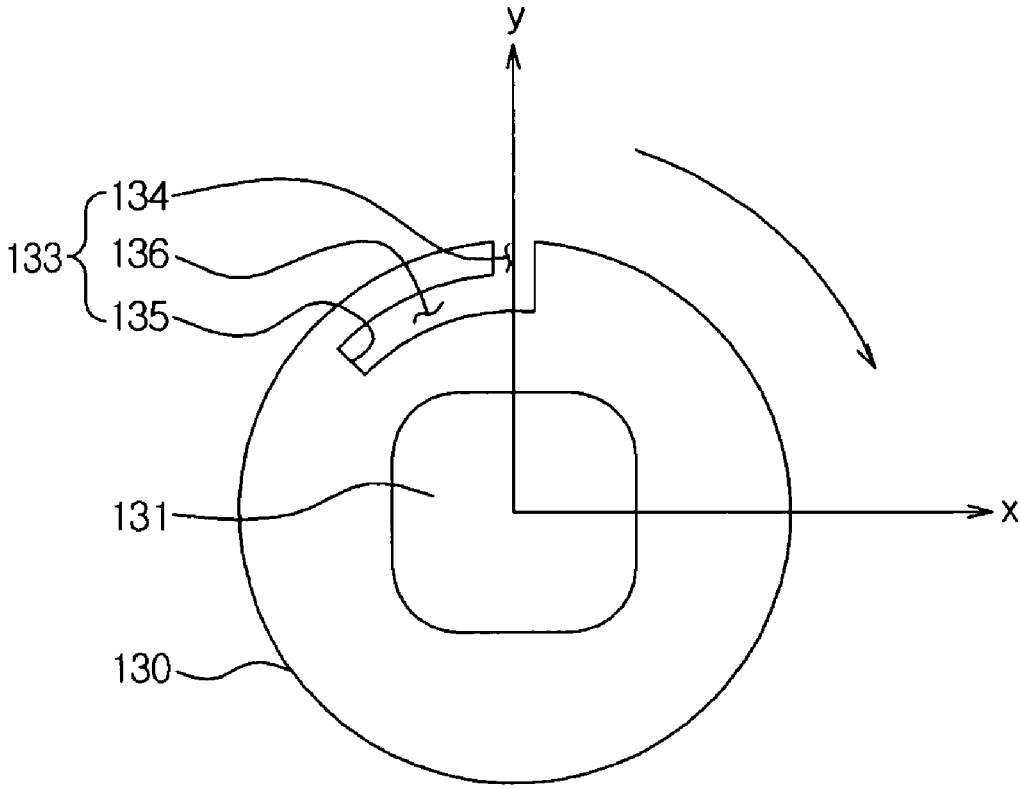
FIG. 6 is a view showing a fixing member provided in a damping unit according to an embodiment of the present invention.

FIG. 6 is a view showing the slot formed in the fixing member according to an embodiment of the present invention.

As shown in FIG. 6, the slot 133 includes an inlet section 134 into which the second lever section 153*b* (FIG. 4) of the torsion spring is inserted, and a guide section 136, which extends from an end of the inlet section 134 in the direction opposite to the rotating direction of the fixing member 130 while forming a predetermined curvature in order to slidably guide the second lever section 153*b* (FIG. 4), which is inserted into the inlet section 134, toward a stopper section 135.

The stopper section 135 is provided at the distal end of the guide section 136 to restrict the movement of the second lever section 153*b* (FIG. 4) of the torsion spring when the fixing member 130 rotates, thereby applying torsional force to the torsional spring.

According to an embodiment of the present invention, the inlet section 134 is separately formed in the slot 133. However, according to embodiments of the present invention, the inlet section 134 may be omitted. For instance, the guide section 136 having predetermined length and depth and the stopper section 135 can be formed in the slot 133 shown in FIG. 5 along the circumferential surface of the fixing member 130 without forming the inlet section 134.

The guide section 136 and the stopper section 135 formed in the slot 133 may serve to adjust the torsional force of the torsion spring in order to adjust the rotational speed of the rotating shaft 114 (FIG. 4) of the oil damper 110 (FIG. 3).

That is, if the fixing member 130 rotates clockwise in a state in which the second lever section 153*b* (FIG. 4) of the torsion spring has been inserted into the inlet section 134 of the slot 133, the second lever section 153*b* (FIG. 4) moves along the guide section 136. If the second lever section 153*b* (FIG. 4) reaches the stopper section 135 of the slot 133, the torsional force is applied to the torsion spring. In this regard, the torsional force of the torsion spring can be adjusted by varying the length of the guide section 136 of the slot 133.

Figure 8:
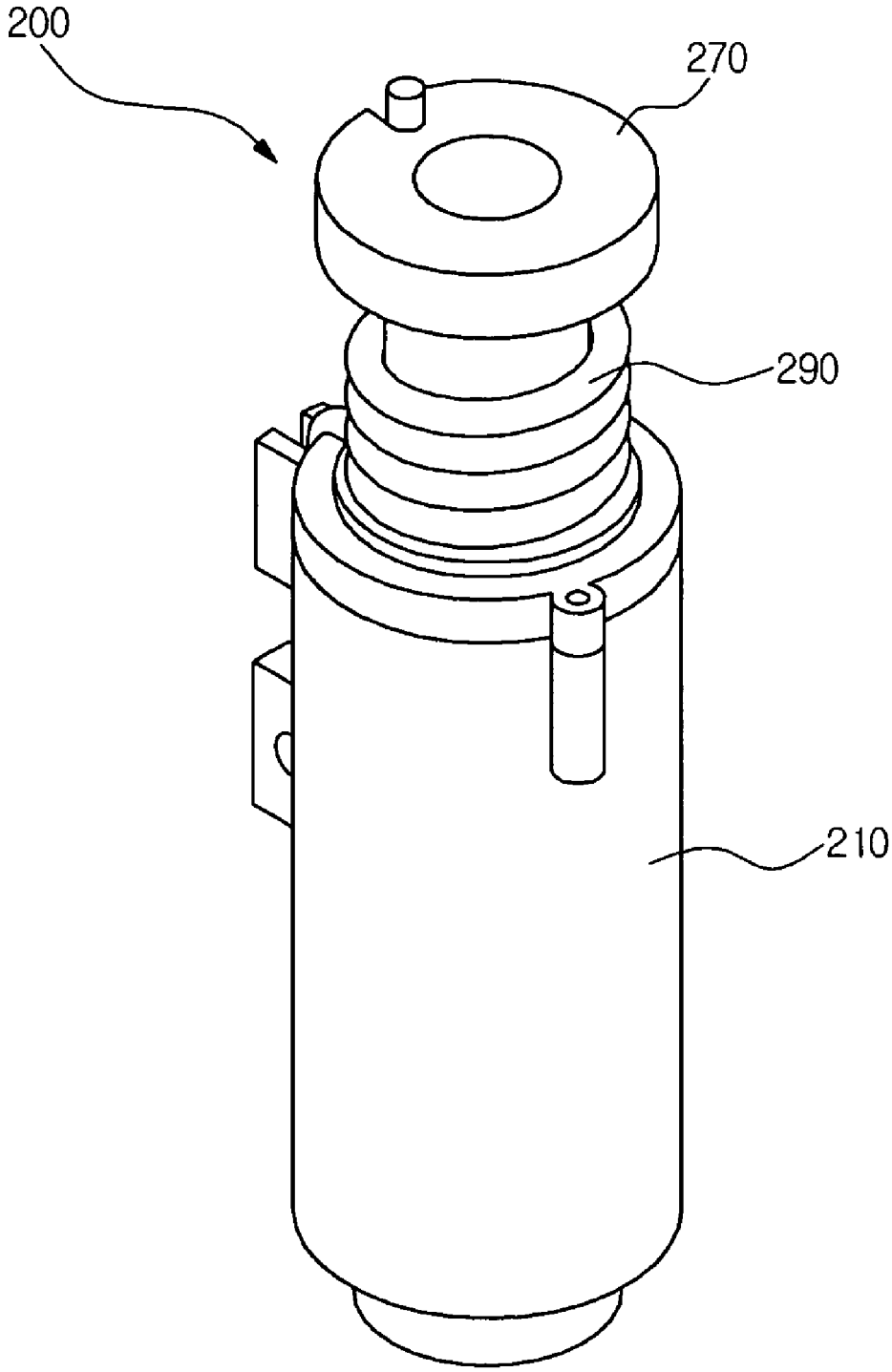
FIG. 8 is a perspective view showing a damping unit according to an embodiment of the present invention.
Figure 9:
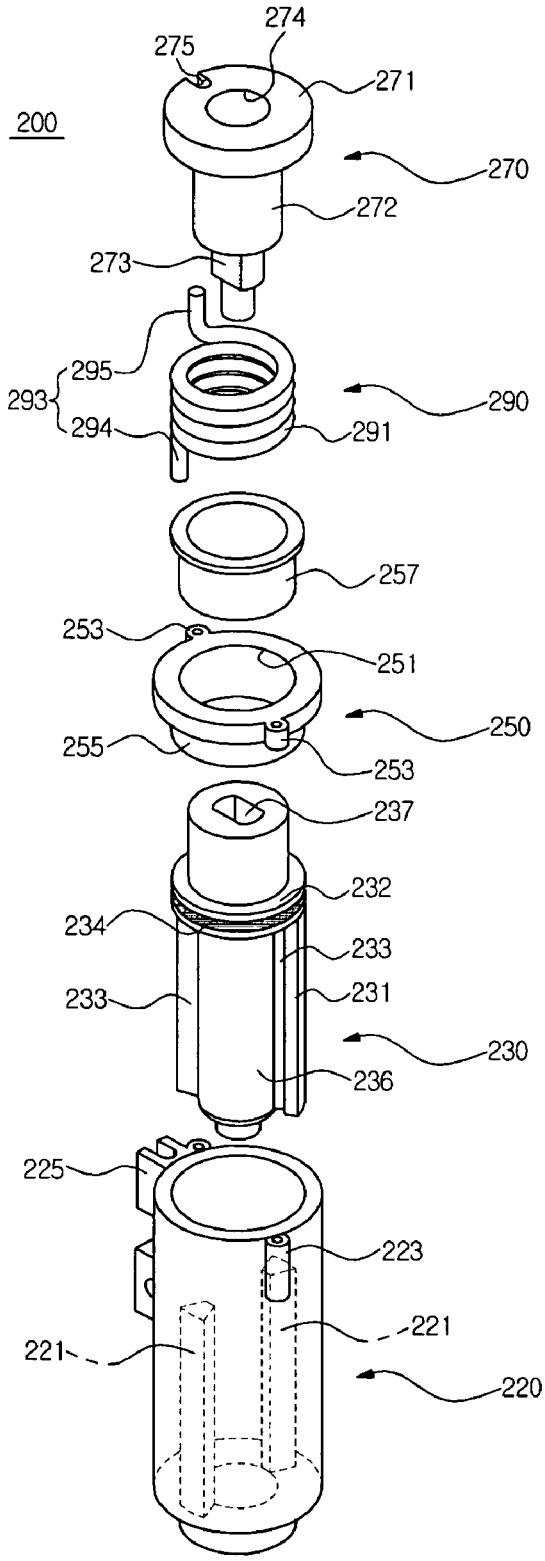
FIG. 9 is an exploded perspective view showing a damping unit according to an embodiment of the present invention.
Figure 10:
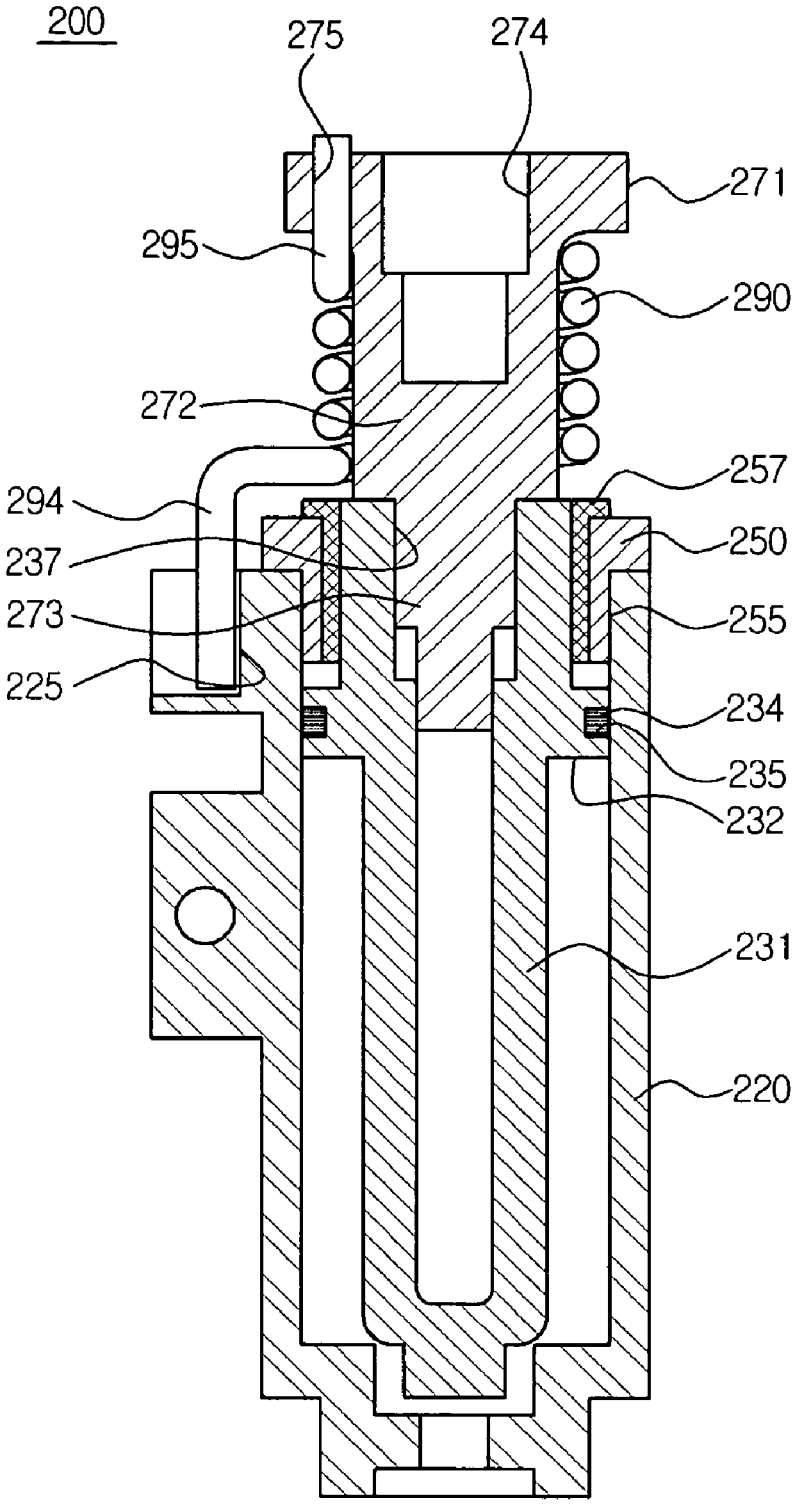
FIG. 10 is a sectional view showing a damping unit according to an embodiment of the present invention.

FIG. 8 is a perspective view showing a damping unit 200 according to an embodiment of the present invention, FIG. 9 is an exploded perspective view showing the damping unit according to an embodiment of the present invention, and FIG. 10 is a sectional view showing a damping unit according to an embodiment of the present invention.

As shown in FIGS. 8 to 10, the damping unit 200 includes an oil damper 210 having a case 220, a rotating member 230 rotatably accommodated in the case 220, a case cover 250 for covering an opening of the case 220, and oil filled in the case 220 to apply resistance against rotation of the rotating member 230.

An upper portion of the case 220 is open and a pair of barriers 221 are installed on the inner wall of the case 220 in opposition to each other. In addition, the case 220 is provided at an outer peripheral surface thereof with a coupling section 223 to fasten the case cover 250 and an elastic member fixing section 225 to which one end of an elastic member 290 is fixed.

The rotating member 230 includes a rotating shaft 231 having a cylindrical structure, a flange 232 attached to an outer surface of the rotating shaft 231, and a pair of blades 233 protruding in the radial direction from the outer surface of the rotating shaft 231 provided below the flange 232.

The flange 232 is formed with a sealing slot 235 around which an O-ring 234 is fitted to prevent oil leakage. A valve 236 made of elastic material can be provided in the blade 233 in order to compress oil contained in the case 220 in the rotational direction of the rotating member 230 only when the rotating member 230 rotates in one direction.

The case cover 250 is formed at the center thereof with a perforation hole 251 and the upper portion of the rotating shaft 231, which protrudes upward out of the flange 232, is inserted into the perforation hole 251. In addition, a coupling section 253 is formed at the outer peripheral surface of the case cover 250 to allow the case cover 250 to be screw-coupled with the case 220. In addition, a cylindrical step portion 255, which is inserted into the case 220, is provided at a lower portion of the case cover 250.

A bushing 257 is provided between the case cover 250 and the rotating shaft 231 in order to prevent the rotating member 230 and the case cover 250 from being broken due to friction.

In addition, the damping unit 200 includes an engagement member 270 coupled with the rotating member 230 to rotate together with the rotating member 230, and the elastic member 290 which applies elastic force to the engagement member 270 in the direction opposite to the rotating direction of the engagement member 270 when the engagement member 270 rotates in one direction.

The engagement member 270 includes a head section 271 coupled to the hinge shaft 53 (FIG. 3), a receiving section 272 for receiving the elastic member 290, and a coupling section 273 coupled to the rotating member 230.

The head section 271 is formed at the center thereof with a hinge hole 274 into which the hinge shaft 53 (FIG. 3) is inserted. A slot 275 is formed at an outer peripheral surface of the head section 271 and one end of the elastic member 290 is inserted into the slot 275.

The slot 275 may include the inlet section 134, the guide section 136, and the stopper section 135 as shown in FIG. 6.

The coupling section 273 has a polygonal shape and is inserted into a coupling hole 237 of the rotating member 230 in order to allow the engagement member 270 to rotate together with the rotating member 230.

According to an embodiment of the present invention, the engagement member 270 is coupled to the rotating member 230. However, embodiments of the present invention are not limited thereto. According to an embodiment of the present invention, the engagement member 270 may be integrally formed with the rotating member 230.

The elastic member 290 may include a torsion spring including a body 291 having an annular coil shape, and a pair of lever sections 293 provided at upper and lower portions of the body 291, respectively. The elastic member 290 is not limited to the torsion spring, but various members, such as spiral springs, can be used as the elastic member 290 if they can apply elastic force in the direction opposite to the rotating direction of the engagement member 270.

The body 291 is configured to surround the receiving section 272 of the engagement member 270 and the lever sections 293 include a first lever section 294 fixed to the elastic member fixing section 225 of the case 220, and a second lever section 295 fixed to the slot 275 formed in the head section 271 of the engagement member 270.

Hereinafter, the operation of the damping unit according to an embodiment of the present invention will be described.

Figure 7:
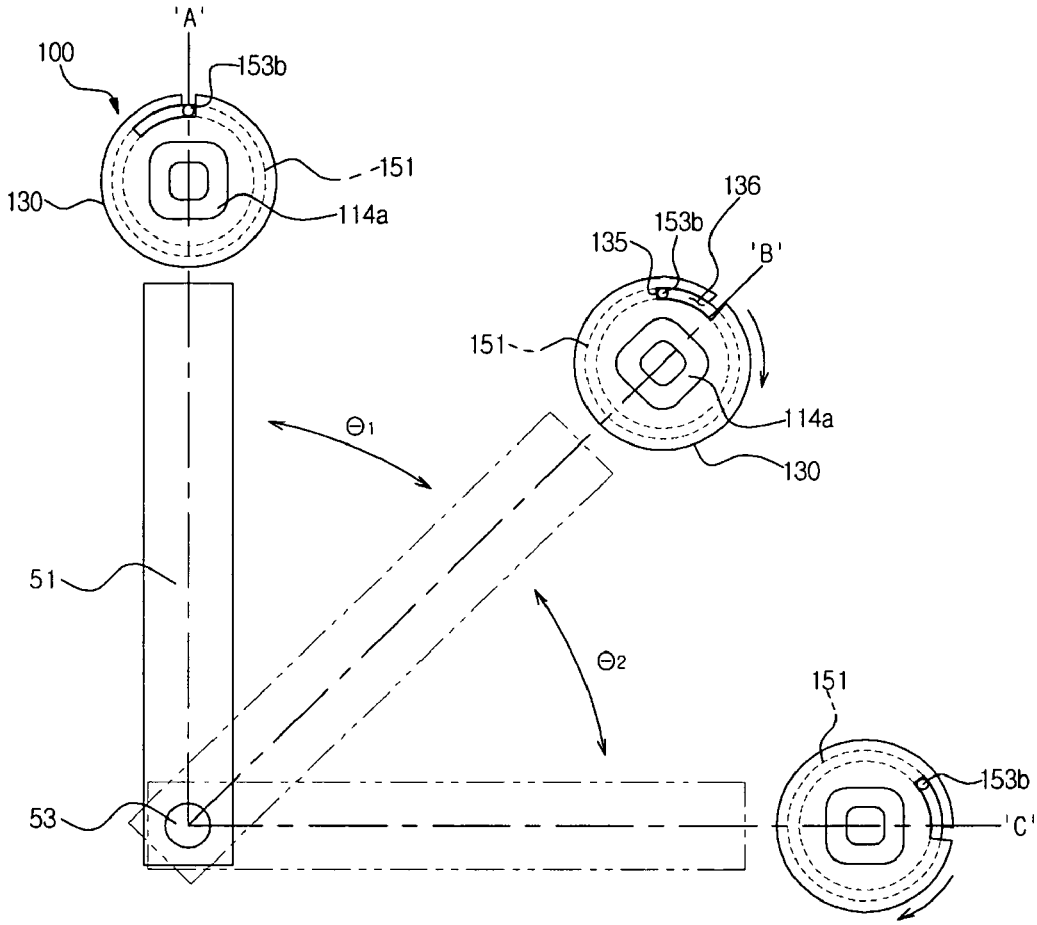
FIG. 7 is a sectional view showing the operation of a damping unit with respect to the opening position of the home bar door according to an embodiment of the present invention.

FIG. 7 is a sectional view showing the operation of the damping unit according to the opening position of the home bar door according to the present invention.

When the home bar door 51 closely adheres to the opening of the storage compartment door 30 (FIG. 1) to close the home bar 50 (see, 'A'), the oil damper 110 (FIG. 3) of the damping unit 100 (FIG. 3) and the elastic member 150 (FIG. 3), which is the torsion spring, are kept in load free state.

When the home bar door 51 is open by a predetermined angle $\theta_1$ (see, 'B'), the rotational speed of the rotating shaft 114 (FIG. 4) of the oil damper 110 (FIG. 3) coupled with the hinge shaft 53 is decreased due to flow resistance of oil contained in the case 111 (FIG. 4), so that the home bar door 51 may be opened slowly.

In this case, the torsion spring provided between the case cover 117 (FIG. 4) and the fixing member 130 is kept in the load free state because the second lever section 153*b* of the torsion spring slidably moves along the guide section 136 of the fixing member 130.

That is, when the home bar door 51 is open by a predetermined angle $\theta_1$, only flow resistance is applied to the rotating shaft 114 (FIG. 4) due to the oil contained in the case 111 (FIG. 4) of the oil damper 110 (FIG. 3).

Then, when the home bar door 51 is being shifted to the complete open position (see, for example, 'C'), beyond the predetermined $\theta_1$ (see, $\theta_2$ in FIG. 7), the movement of the second lever section 153*b* of the torsion spring is restricted by the stopper section 135, so that torsional force is applied to the torsion spring.

Therefore, the home bar door 51 is more slowly opened due to the flow resistance of the oil damper 110 (FIG. 3) and elastic force of the torsion spring, so that operational stability of the home bar door 51 can be improved.

In contrast, if the user rotates the home bar door 51 counterclockwise to close the home bar 50 (FIG. 2), the elastic force of the torsion spring may compensate for the flow resistance of the oil damper 110 (FIG. 3) in the period of $\theta_2$, so that the user can easily rotate the home bar door 51 with relatively little force as compared with the case in which the user rotates the home bar door 51 by using the oil damper 110 (FIG. 3). Thus, operational stability of the home bar door 51 can be remarkably improved.

In addition, since torsional force of the torsion spring can be properly set according to the weight of the home bar door 51 and viscosity of the oil, embodiments of the present invention are applicable for various products. Further, the aesthetic appearance of the refrigerator can be improved due to the damping unit 100 (FIG. 3) having the oil damper 110 (FIG. 3) integrally formed with the torsion spring, and the rotational speed of the home bar door 51 can be controlled by using a simple structure so that the productivity can be improved.

In addition, the rotational speed of the home bar door 51 can be adjusted according to the preference of the user by controlling the interaction between the flow resistance of the oil damper 110 (FIG. 3) and elastic force of the elastic member 150 (FIG. 3), so that the reliability of the product can be improved.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body;

a refrigerator door for opening and closing a front surface of the body, the refrigerator door having an opening;

an auxiliary door for opening and closing the opening of the refrigerator door; and a damping unit coupled to a hinge shaft of the auxiliary door to control an opening and closing speed of the auxiliary door, wherein the damping unit includes a case with a hollow structure and an open upper portion, a case cover to cover the open upper portion of the case, a rotating member rotatably installed in the case, oil filled in the case to apply resistance against rotation of the rotating member, a fixing member coupled to an end portion of a rotating shaft, protruding out of the case cover, of the rotating member, to rotate together with the rotating member, and an elastic member provided between the case and the fixing member to apply elastic force to the fixing member in a direction opposite to an opening direction of the auxiliary door, wherein the elastic member includes a first lever section provided at a first end of the elastic member and directly fixed to the case or the case cover, and a second lever section provided at a second end of the elastic member and directly fixed to the fixing member.

2. The refrigerator as claimed in claim 1, wherein the elastic member includes a torsion spring having a body with an annular coil shape configured to surround the rotating shaft.

3. The refrigerator as claimed in claim 2, wherein the fixing member is formed with a slot into which the second lever section is accommodated.

4. The refrigerator as claimed in claim 3, wherein the slot includes a guide section along which the second lever section slidably moves, and a stopper section for restricting movement of the second lever section.

5. The refrigerator as claimed in claim 3, wherein the slot is located at a predetermined position of the fixing member to apply torsional force to the torsion spring such that the auxiliary door is securely maintained in a closed position.

6. The refrigerator as claimed in claim 1, wherein the hinge shaft is integrally formed with the rotating shaft.

7. A refrigerator comprising:

a body;

a refrigerator door for opening and closing a front surface of the body, the refrigerator door having an opening;

an auxiliary door for opening and closing the opening of the refrigerator door; and a damping unit coupled to a hinge shaft of the auxiliary door to control an opening and closing speed of the auxiliary door, wherein the damping unit includes an oil damper having a case with a hollow structure and an open upper portion, a case cover to cover the open upper portion of the case, a rotating member rotatably installed in the case, and oil filled in the case to apply resistance against rotation of the rotating member, an engagement member coupled to a portion of the rotating member protruding out of the case cover, to rotate together with the rotating member, and an elastic member to apply elastic force to the engagement member in a direction opposite to an opening direction of the auxiliary door, wherein the elastic member has one end directly fixed to the case or case cover and an opposite end directly fixed to the engagement member.

8. The refrigerator as claimed in claim 7, wherein the engagement member includes a head section having a hinge hole into which the hinge shaft is inserted, a receiving section for receiving the elastic member, and a coupling section coupled to the rotating member.

9. The refrigerator as claimed in claim 8, wherein the elastic member includes a torsion spring, which surrounds the receiving section and the opposite end is fixed to the head section.

10. The refrigerator as claimed in claim 9, wherein the head section is formed with a slot into which the opposite end of the torsion spring is accommodated.

11. The refrigerator as claimed in claim 10, wherein the slot includes a guide section along which the opposite end of the torsion spring slidably moves, and a stopper section for restricting movement of the opposite end of the torsion spring.

12. The refrigerator as claimed in claim 10, wherein the slot is located at a predetermined position of the head section to apply torsional force to the torsion spring such that the auxiliary door is securely maintained in a closed position.

13. The refrigerator as claimed in claim 10, wherein the engagement member is integrally formed with the rotating member.

14. A damping unit for a door on a refrigerator comprising:

a damper comprising:

a case with a hollow structure and an open upper portion;

a case cover to cover the open upper portion of the case, the case being filled with oil to provide resistance against rotation of a rotating member, wherein the rotating member comprises a rotating shaft and is rotatably installed in the case;

a fixing member coupled to a portion of the rotating shaft protruding out of the case cover; and an elastic member between the fixing member and the case cover, to apply an elastic force to the fixing member in a direction opposite to a rotating direction of the fixing member, wherein the elastic member has a first lever section directly fixed to the case or case cover and a second lever section directly fixed to the fixing member.

15. The damping unit as claimed in claim 14, wherein the elastic member is a torsion spring.

16. The damping unit as claimed in claim 15, wherein the fixing member has a slot for fixing or guiding the second lever section of the torsion spring such that torsional force can be applied to the torsion spring according to the rotation direction of the fixing member.

17. The damping unit as claimed in claim 16, wherein a position of the slot formed in the fixing member is selected to adjust torsional force of the torsion spring.

18. The damping unit as claimed in claim 14, wherein the rotating shaft has an end portion protruding out of a perforation hole of the case cover.

19. The damping unit as claimed in claim 18, wherein the fixing member is formed with an insertion hole into which the end portion of the rotating shaft is inserted.

20. The damping unit as claimed in claim 19, wherein the insertion hole has a polygonal shape to allow the fixing member to rotate together with the rotating shaft.

* * * * *